US006089912A

United States Patent [19]

Tallis et al.

[11] Patent Number: 6,089,912

[45] Date of Patent: Jul. 18, 2000

[54] POST-LESS COAXIAL CABLE CONNECTOR

[75] Inventors: John R. Tallis, Horseheads; John R. Radzik, Trumansburg; Ronald P. Locati; Jason C. Perry, both of Elmira; Andrew J. Kempf, Dewitt; Thomas G. Macek, Endicott, all of N.Y.

[73] Assignee: Thomas & Betts International, Inc., Sparks, Nev.

[21] Appl. No.: 08/957,982

[22] Filed: Oct. 21, 1997

(Under 37 CFR 1.47)

Related U.S. Application Data

[60] Provisional application No. 60/029,078, Oct. 23, 1996.

[51] Int. Cl.[7] ..... H01R 9/05

[52] U.S. Cl. ..... 439/584; 439/583

[58] Field of Search ..... 439/583, 584, 439/578, 462

[56] References Cited

U.S. PATENT DOCUMENTS

| | | | |
|---|---|---|---|
| D. 327,872 | 7/1992 | McMillis et al. | D13/133 |
| D. 340,170 | 10/1993 | McMIllis et al. | D8/14 |
| D. 350,053 | 8/1994 | McMillis et al. | D8/14 |
| 2,435,989 | 2/1948 | Webster | 174/84 |
| 2,785,384 | 3/1957 | Wickesser | 339/94 |
| 3,336,563 | 8/1967 | Hyslop | 339/61 |
| 3,406,373 | 10/1968 | Forney, Jr. | 339/97 |
| 3,474,391 | 10/1969 | Gartzke et al. | 339/103 |
| 3,498,647 | 3/1970 | Schroder | 285/343 |
| 3,541,495 | 11/1970 | Ellis et al. | 339/177 |
| 3,550,064 | 12/1970 | Caller et al. | 339/65 |
| 3,551,882 | 12/1970 | O'Keefe | 339/177 |
| 3,581,269 | 5/1971 | Frey | 339/94 |
| 3,629,792 | 12/1971 | Dorrell | 339/60 M |
| 3,634,815 | 1/1972 | Stevens | 399/177 E |
| 3,706,958 | 12/1972 | Blanchenot | 339/177 E |
| 3,708,781 | 1/1973 | Trompeter | 339/177 R |
| 3,744,011 | 7/1973 | Blanchenot | 339/177 R |
| 3,836,700 | 9/1974 | Niemeyer | 174/89 |
| 3,846,738 | 11/1974 | Nepovim | 339/177 R |
| 3,847,463 | 11/1974 | Hayward et al. | 339/8 P |
| 3,963,320 | 6/1976 | Spinner | 339/177 R |
| 3,985,418 | 10/1976 | Spinner | 339/177 R |
| 4,046,451 | 9/1977 | Juds et al. | 339/177 R |
| 4,053,200 | 10/1977 | Pugner | 339/177 R |
| 4,059,330 | 11/1977 | Shirey | 339/177 R |
| 4,126,372 | 11/1978 | Hashimoto et al. | 339/177 E |
| 4,156,554 | 5/1979 | Aujla | 339/177 R |
| 4,280,749 | 7/1981 | Hemmer | 339/177 R |

(List continued on next page.)

FOREIGN PATENT DOCUMENTS

| | | | |
|---|---|---|---|
| 134 358 | 3/1985 | European Pat. Off. | H01R 17/12 |
| 1087228 | 10/1967 | United Kingdom . | |
| 1270846 | 4/1972 | United Kingdom . | |
| 2079549 | 1/1982 | United Kingdom . | |

*Primary Examiner*—Khiem Nguyen
*Assistant Examiner*—Michael C. Zarroli
*Attorney, Agent, or Firm*—Weingarten, Schurgin, Gagnebin & Hayes LLP

[57] ABSTRACT

A coaxial cable connector includes a sleeve and a collar configured to receive the sleeve substantially therein, the sleeve is configured to receive a coaxial cable and has at least one slot extending longitudinally forming a plurality of sides, each side having at least one tooth for engaging a coaxial cable. A threaded nut is also provided with one end of the nut disposed coaxially around and rotatable about a mating area of the collar. The connector also includes a ground coupler that is centrally disposed along a common longitudinal axis within one end of the collar and one end of the nut. The connector can also include an actuator that is configured to receive a coaxial cable and is centrally disposed along a common longitudinal axis within one end of the collar and is disposed within the collar such that the innermost end of the actuator abuts the outermost end of the sleeve, whereby inward pressure on the actuator forces the sleeve into press fit engagement between the collar and the jacket of a coaxial cable.

38 Claims, 7 Drawing Sheets

U.S. PATENT DOCUMENTS

| | | | |
|---|---|---|---|
| 4,346,958 | 8/1982 | Blanchard | 339/177 R |
| 4,360,244 | 11/1982 | Forney, Jr. et al. | 339/177 R |
| 4,374,606 | 2/1983 | Lathrop | 339/177 R |
| 4,408,821 | 10/1983 | Forney, Jr. et al. | 339/177 R |
| 4,408,822 | 10/1983 | Nikitas | 339/177 R |
| 4,441,781 | 4/1984 | Forney, Jr. et al. | 339/177 R |
| 4,444,453 | 4/1984 | Kirby et al. | 339/177 R |
| 4,450,231 | 5/1984 | Forney, Jr. | 339/94 C |
| 4,452,503 | 6/1984 | Forney, Jr. | 339/177 R |
| 4,502,749 | 3/1985 | Forney, Jr. et al. | 339/177 R |
| 4,553,806 | 11/1985 | Forney, Jr. et al. | 339/94 C |
| 4,570,055 | 2/1986 | McMills | 219/541 |
| 4,575,274 | 3/1986 | Hayward | 403/2 |
| 4,583,811 | 4/1986 | McMills | 339/177 R |
| 4,593,964 | 6/1986 | Forney, Jr. et al. | 339/177 R |
| 4,600,263 | 7/1986 | DeChamp et al. | 339/177 R |
| 4,614,390 | 9/1986 | Baker | 339/61 R |
| 4,619,496 | 10/1986 | Forney, Jr. et al. | 339/177 R |
| 4,639,068 | 1/1987 | McMills et al. | 339/177 R |
| 4,648,684 | 3/1987 | Mattis et al. | 339/177 R |
| 4,650,228 | 3/1987 | McMills et al. | 285/381 |
| 4,650,271 | 3/1987 | Forney, Jr. et al. | 339/177 R |
| 4,655,129 | 4/1987 | McMills | 116/212 |
| 4,662,703 | 5/1987 | Forney, Jr. et al. | 339/177 R |
| 4,674,818 | 6/1987 | McMills et al. | 439/275 |
| 4,676,577 | 6/1987 | Szegda | 439/584 |
| 4,712,296 | 12/1987 | Forney, Jr. et al. | 29/828 |
| 4,717,355 | 1/1988 | Mattis | 439/452 |
| 4,818,237 | 4/1989 | Weber | 439/693 |
| 4,824,399 | 4/1989 | Bogar et al. | 439/578 |
| 4,834,675 | 5/1989 | Samchisen | 439/578 |
| 4,854,893 | 8/1989 | Morris | 439/578 |
| 4,869,679 | 9/1989 | Szegda | 439/272 |
| 4,902,246 | 2/1990 | Samchisen | 439/578 |
| 4,952,174 | 8/1990 | Sucht et al. | 439/584 |
| 4,990,106 | 2/1991 | Szegda | 439/585 |
| 4,993,964 | 2/1991 | Trummer | 439/272 |
| 4,998,895 | 3/1991 | Forney et al. | 439/585 |
| 5,002,503 | 3/1991 | Campbell et al. | 439/578 |
| 5,011,432 | 4/1991 | Sucht et al. | 439/584 |
| 5,024,606 | 6/1991 | Ming-Hwa | 439/578 |
| 5,055,068 | 10/1991 | Machura et al. | 438/581 |
| 5,059,139 | 10/1991 | Spinner | 439/583 |
| 5,060,373 | 10/1991 | Machura et al. | 29/858 |
| 5,073,129 | 12/1991 | Szegda | 439/585 |
| 5,100,344 | 3/1992 | Truong | 439/578 |
| 5,127,853 | 7/1992 | McMills et al. | 439/578 |
| 5,194,012 | 3/1993 | Cairns | 439/201 |
| 5,195,906 | 3/1993 | Szegda | 439/394 |
| 5,207,602 | 5/1993 | McMills et al. | 439/836 |
| 5,217,391 | 6/1993 | Fisher, Jr. | 439/578 |
| 5,269,701 | 12/1993 | Leibfried, Jr. | 439/578 |
| 5,277,598 | 1/1994 | McMills et al. | 439/133 |
| 5,283,853 | 2/1994 | Szegda | 385/139 |
| 5,295,864 | 3/1994 | Birch et al. | 439/578 |
| 5,297,972 | 3/1994 | McMills et al. | 439/133 |
| 5,315,684 | 5/1994 | Szegda | 385/139 |
| 5,318,458 | 6/1994 | Thörner | 439/427 |
| 5,340,325 | 8/1994 | Pai | 439/188 |
| 5,342,218 | 8/1994 | McMills et al. | 439/578 |
| 5,352,134 | 10/1994 | Jacobsen et al. | 439/584 |
| 5,362,250 | 11/1994 | McMills et al. | 439/387 |
| 5,371,819 | 12/1994 | Szegda | 385/75 |
| 5,371,827 | 12/1994 | Szegda | 385/136 |
| 5,393,244 | 2/1995 | Szegda | 439/394 |
| 5,431,583 | 7/1995 | Szegda | 439/589 |
| 5,435,736 | 7/1995 | McMills et al. | 439/133 |
| 5,444,810 | 8/1995 | Szegda | 385/139 |
| 5,456,611 | 10/1995 | Henry et al. | 439/180 |
| 5,456,614 | 10/1995 | Szegda | 439/321 |
| 5,469,613 | 11/1995 | McMills et al. | 29/751 |
| 5,470,257 | 11/1995 | Szegda | 439/578 |
| 5,474,478 | 12/1995 | Ballog | 439/805 |
| 5,486,120 | 1/1996 | McMills et al. | 439/521 |
| 5,490,803 | 2/1996 | McMills et al. | 439/276 |
| 5,491,315 | 2/1996 | McMills et al. | 200/504 |
| 5,651,698 | 7/1997 | Locati et al. | 439/578 |
| 5,662,489 | 9/1997 | Stirling | 439/322 |
| 5,800,211 | 9/1998 | Stabile et al. | 439/578 |

POST-LESS COAXIAL CABLE CONNECTOR

CROSS REFERENCE TO RELATED APPLICATIONS

This application claims the benefit of U.S. Provisional Application Serial No. 60/029,078, filed Oct. 23, 1996.

STATEMENT REGARDING FEDERALLY SPONSORED RESEARCH OR DEVELOPMENT

-N/A-

BACKGROUND OF THE INVENTION

The present invention relates generally to electrical connectors and more particularly to coaxial cable connectors.

Coaxial cable connectors typically include a body, nut, and post made of electrically conductive materials. The typical coaxial cable comprises a central conductor which is surrounded by a metallic outer conductor and shield. A dielectric separates the central conductor from the outer conductor and an insulating jacket covers the outer conductor. Additionally, O rings may be included in the connector to provide moisture and dust protection and to minimize RF signal loss. These coaxial cable connectors are cumbersome to assemble.

Coaxial cable connectors of this type are used broadly, especially in cable television applications, and provide for high quality on of video and other signals. In order to effectively use the cable connectors, a connector must be fitted at least one end of a cable. A connector, in order to be practical, must provide for a reliable, mechanical, and electrical connection as well as being simple to install and use.

Coaxial cables typically used for cable television (CATV) purposes in Europe have a polyethylene (PE) jacket that is very stiff in comparison with the coaxial cables used in the United States, which typically have a more pliable polyvinyl chloride (PVC) jacket. Accordingly, connectors used with PVC jacketed coaxial cables are not easily utilized for making connections to PE jacketed coaxial cables. PE jackets are extremely difficult to fit into current coaxial cable connectors due to the need of the cable to expand enough to slide over the post of the connector.

Examples of prior art press fit connectors for coaxial cables are described in U.S. Pat. Nos. 4,834,675 and 4,902,246 to Samchisen. These connectors are easily assembled, having a sleeve which is fitted into a collar, and include O-rings for sealing out moisture, and a metallic post, collar, sleeve and nut. U.S. Pat. No. 5,470,257 to Szegda also describes a similar connector. The Szegda connector also includes O-rings for sealing out moisture and a post, collar, nut and sleeve.

It would be desirable to provide a coaxial cable connector capable of working with both common (PVC) jacketed drop cable and (PE) jacketed cable. It would also be desirable to provide a connector that exhibits a wider dynamic range than existing configurations and provide increased cable retention and an enhanced environmental seal for a greater span of cable dimensions. Additionally, it would be desirable to provide a connector without a post to allow easier manual insertion of a cable into the connector, without loss of cable retention, ground connection, and environmental seal.

SUMMARY OF THE INVENTION

The present invention overcomes the disadvantages of difficult installation and sealing by providing a coaxial cable connector that is easily utilized with both PVC and PE cables. The connector does not use a post, thereby creating a simpler, more reliable connector that allows the jacket of a cable to be easily mated with the connector assembly. As the connector pieces are mated together a secure connection between the connector and the coaxial cable is produced.

The connector includes a collar that has two open ends and a bore centrally disposed therethrough. The connector further includes a sleeve that has two open ends and a bore centrally disposed therethrough with one end configured to receive a coaxial cable. The sleeve has one or more slots extending longitudinally a predetermined length forming a plurality of sides, each side having at least one tooth for engaging and securing a jacket of a coaxial cable. One end of the sleeve has a mating area that can engage with a mating area of one of the ends of the collar. A threaded nut is also provided, which has two open ends and a bore centrally disposed therethrough with one end of the nut disposed coaxially around and rotatable about another mating area of the collar. The connector also includes a ground coupler that has two open ends and a bore centrally disposed therethrough. The ground coupler is centrally disposed along a common longitudinal axis within one end of the collar and one end of the nut.

In another embodiment, the connector can further include an actuator that has two open ends and is configured to receive a coaxial cable. The actuator has a bore centrally disposed therethrough and a shoulder that can abut the outer edge of the collar. The actuator is centrally disposed along a common longitudinal axis within one end of the collar and is disposed within the collar such that the innermost end of the actuator abuts the outermost end of the sleeve, whereby inward pressure on the actuator forces the sleeve into engagement between the collar and the jacket of a coaxial cable.

DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1A:
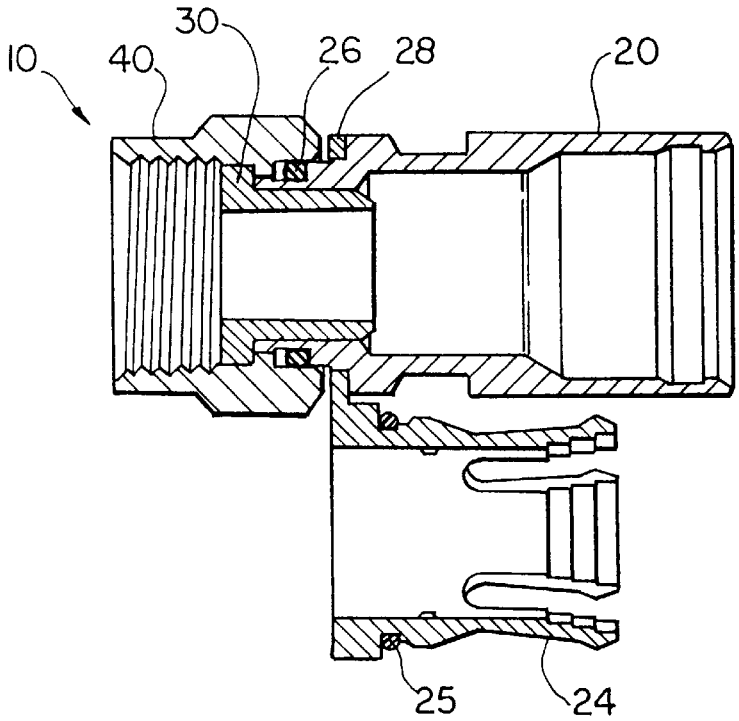
FIG. 1A is a cross-sectional view of an embodiment of a connector of the present invention.
Figure 1B:
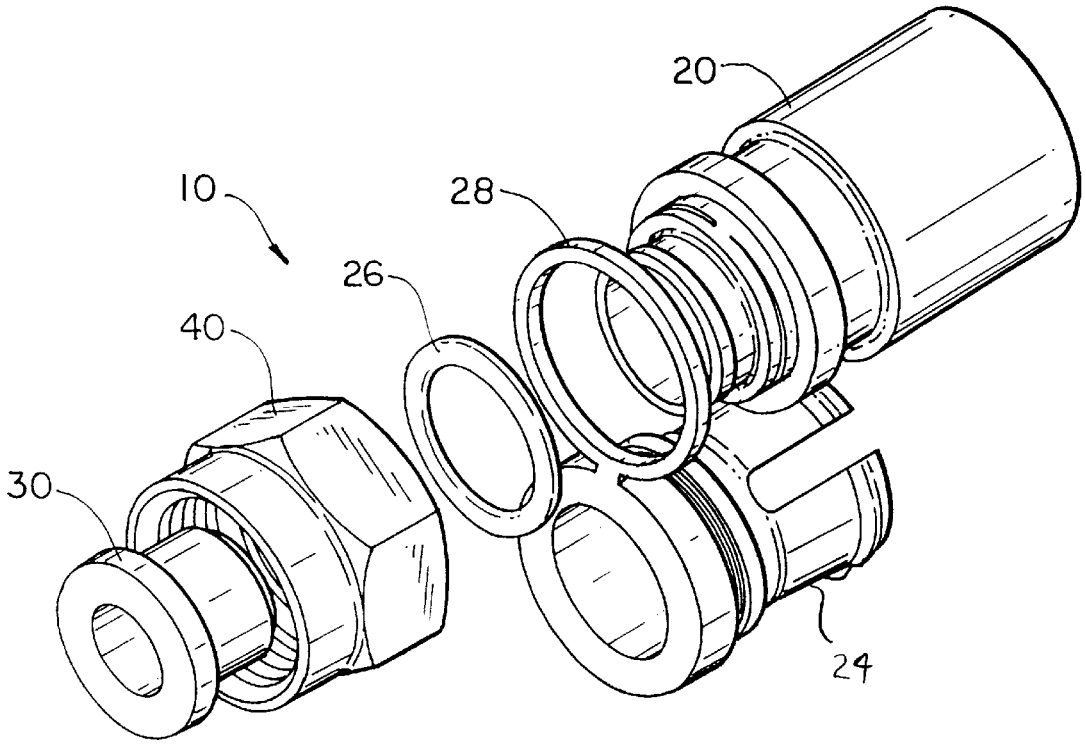
FIG. 1B is an exploded isometric view of the connector of FIG. 1A.

FIGS. 1A and 1B show an embodiment of a coaxial connector 10 according to the present invention. The connector 10 comprises a collar 20, a sleeve 24, a sleeve seal 25, a seal 26, a retaining ring 28, a ground coupler 30, and a nut 40. The sleeve 24 is adapted to be fit into the proximal end of the collar 20, and provides for secure mechanical and electrical connection of the connector onto a prepared end of a coaxial cable.

Figure 2A:
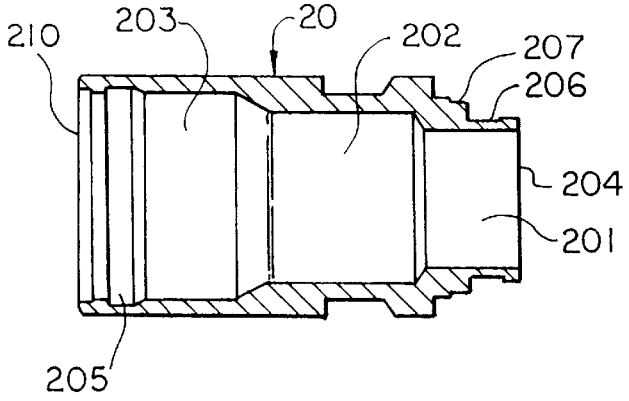
FIG. 2A is a cross-sectional view of the collar of FIGS. 1A and 1B.
Figure 2B:
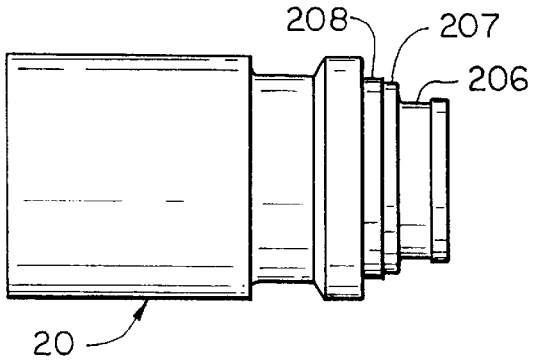
FIG. 2B is an illustration of the collar of FIGS. 1A and 1B.
Figure 2C:
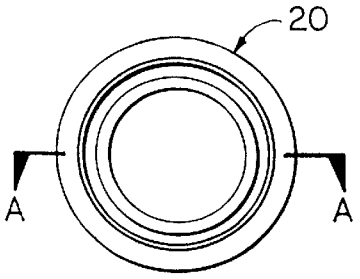
FIG. 2C is an end view of the collar of FIGS. 1A and 1B.

The collar 20, shown in FIGS. 2A, 2B, and 2C, would typically be comprised of brass or other conductive material. The collar 20 is open on each of two ends and has a first central bore 201 disposed therethrough. First central bore 201 is configured to fit a first end 301 of ground coupler 30 substantially therein. A second central bore 202, having a larger diameter than first central bore 201 is disposed from the first end 204 of the collar 20 a predetermined distance into the collar 20. Second central bore 202 is configured to fit a first end 414, shown in FIG. 4A, of sleeve 24 therein to create a fit that securely connects the sleeve onto a prepared end of a coaxial cable. A third bore 203 is disposed a predetermined distance from the first end 204 of collar 20 and is configured to accommodate the second end 420 of sleeve 24. Third bore 203 has a larger diameter than second bore 202, and, in the particular embodiment shown, includes an interior annular groove 205 for receiving a cooperating lip 405 of the sleeve 24, which is configured to securely fit into annular groove 205. An exterior annular groove 206 is provided proximate the first end 204 of collar 20. Exterior annular groove 206 is configured to receive a seal 26, such as an O-ring, shown in FIGS. 1A and 1B, thereon. Proximate the exterior annular groove 206 is a first exterior surface 207, which is configured to be received into a cooperating first end 606, shown in FIG. 6A, of nut 40. The collar 20 can further include a second exterior surface 208, which a retaining ring 28 integrally formed with sleeve 24, shown in FIGS. 1A and 1B, may be fit prior to the collar 20 being mated with the nut 40, thus preventing the loss or misplacement of the sleeve 24 prior to use of the connector.

Figure 3A:
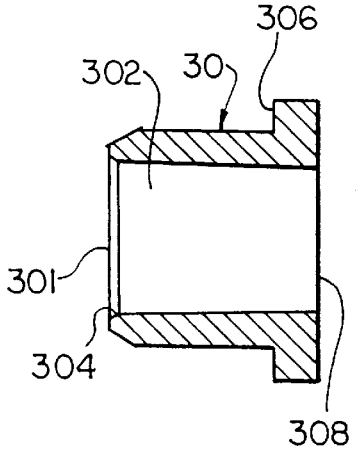
FIG. 3A is a cross-sectional view of the ground coupler of FIGS. 1A and 1B.
Figure 3B:
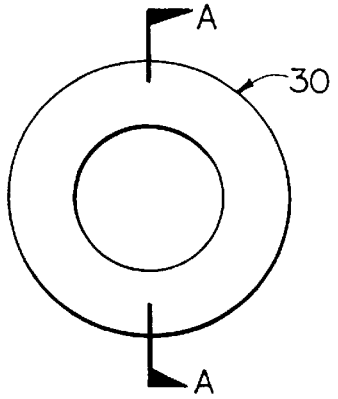
FIG. 3B is an end view of the ground coupler of FIGS. 1A and 1B.

Ground coupler 30 is shown in FIGS. 3A and 3B. Ground coupler 30 is comprised of conductive material, and is open on each of two ends and includes a bore 302 disposed therethrough. Ground coupler 30 also includes a tapered edge 304 proximate the first end 301 of the ground coupler 30. Ground coupler 30 further includes an external shoulder 306 proximate its second end 308 for conduction between a braided shield of a coaxial cable and a cooperating connector. Shoulder 306 abuts an internal shoulder 609 of nut 40, shown in FIG. 6, in order to secure the placement of the ground coupler 30 within the nut 40 and collar 20.

Figure 4A:
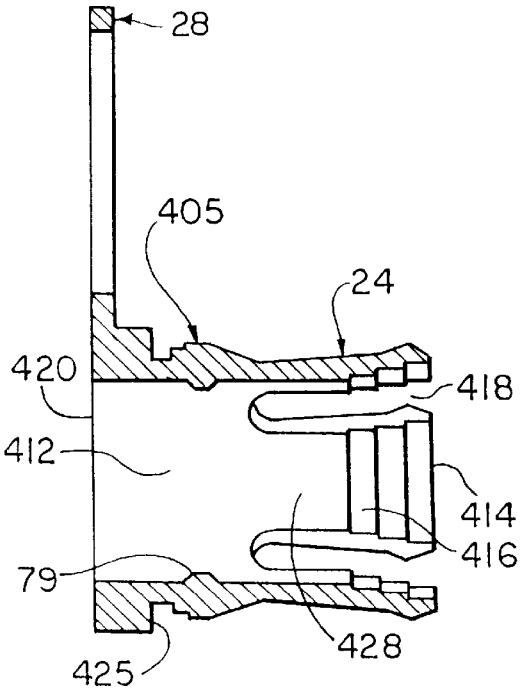
FIG. 4A is a cross-sectional view of the sleeve of FIGS. 1A and 1B.
Figure 4B:
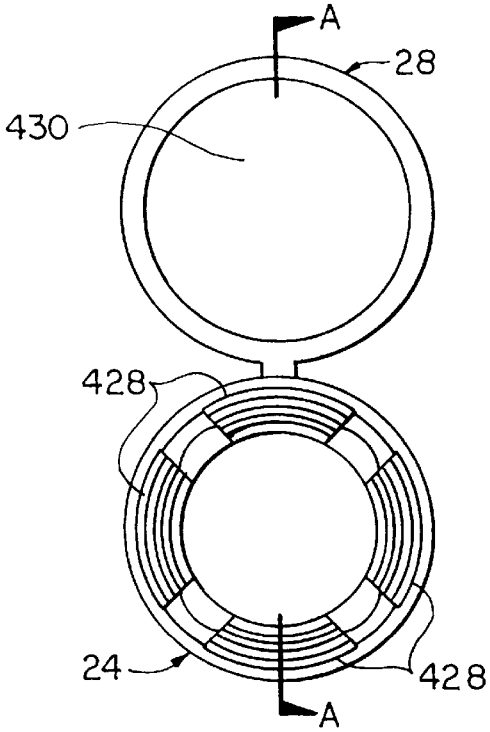
FIG. 4B is an end view of the sleeve of FIGS. 1A and 1B.
Figure 5:
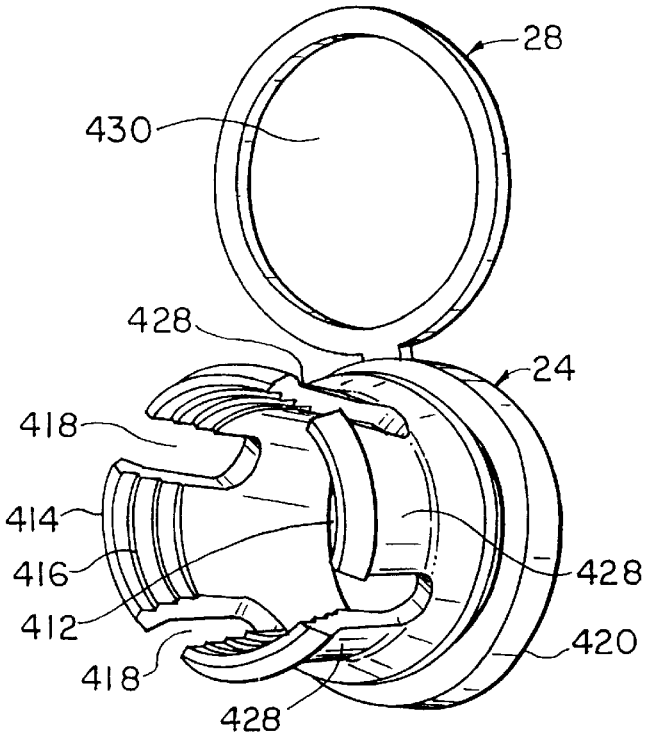
FIG. 5 is an exploded isometric view of the sleeve of FIGS. 1A and 1B.
Figure 7:
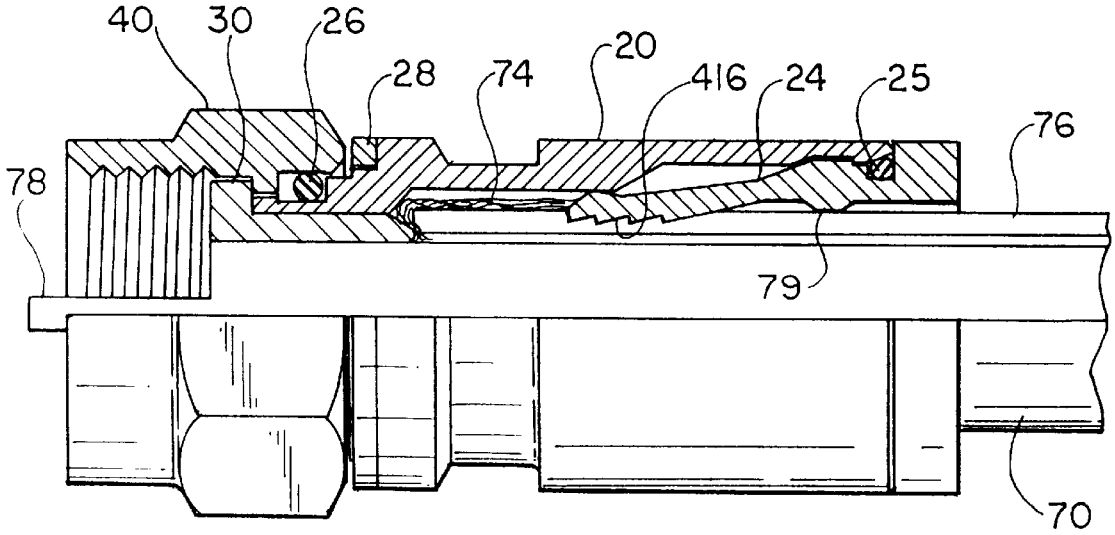
FIG. 7 is a cross-sectional view of the connector of FIGS. 1A and 1B assembled and installed onto a coaxial cable.

Referring now to FIGS. 4A, 4B and 5, the sleeve 24 is shown. The sleeve 24 is open on each of each of two ends and has a central bore 412 disposed therethrough. The sleeve 24 is tooth laden and slotted proximate the first end 414. One or more slots 418 extend longitudinally a defined length from the first end 414 of sleeve 24 forming a plurality of separated sides 428. Teeth 416 are positioned on each side 428 around the circumference proximate the first end 414 of the sleeve 24. The slots 418 are provided to allow the sides 428 having teeth 416 to close down onto a cable jacket when installed into the back of the collar 20, as shown in FIG. 7. The sleeve 24 also includes shoulder 425, which is provided to create a positive stop against the second end 210 of collar 20, as shown in FIG. 7, when being press fit into the collar 20. As discussed with relation to collar 20, the lip 405 is provided to securely fit into annular grove 205 of collar 20. The sleeve 24 also can be color coded, or stamped, or otherwise marked at the cable insertion end.

The sleeve 24 can also attach to the connector in a before use position in different ways. FIGS. 1–7 represent an embodiment where sleeve 24 includes a retaining ring 28 having a central bore 430, which is sized to fit around the second exterior surface 208 of the collar 20 behind the nut 40 from which the sleeve can be broken off and installed. This configuration allows the sleeve 24 to be kept together with the connector until the connector is assembled. FIGS. 8–12 represent an embodiment where the sleeve 24' is pre-installed into the collar 20', so that the user can simply push the cable into the connector and then engage the sleeve the rest of the way.

Different environmental sealing alternatives are possible in this configuration. For example, the sleeve can be configured so that its internal circumference creates a seal against the jacket of a coaxial cable.

Figure 6A:
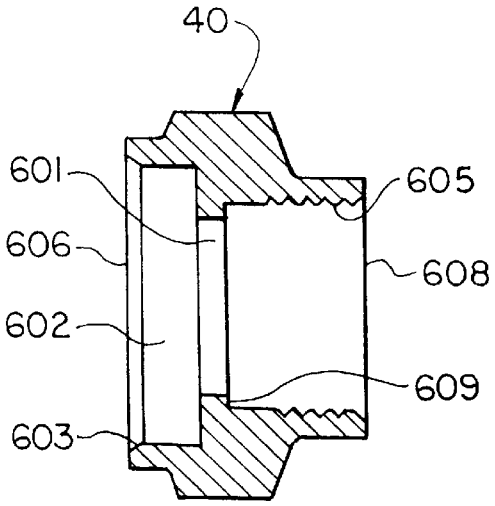
FIG. 6A is a cross-sectional view of the nut of FIGS. 1A and 1B.
Figure 6B:
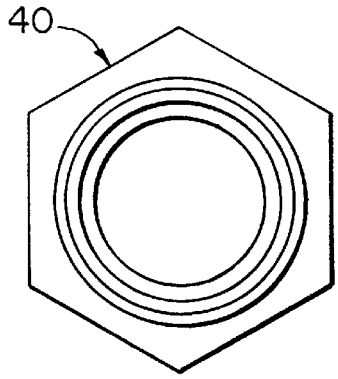
FIG. 6B is an end view of the nut of FIGS. 1A and 1B.

Referring now to FIGS. 6A and 6B, a nut 40 is shown. Typically, nut 40 would be comprised of brass or other conductive material. Nut 40 has a first central bore 601 disposed therethrough and configured to receive the ground coupler 30 therein. A second bore 602 is disposed a predetermined distance within a first end 606 of nut 40. Second bore 602 is configured to receive a cooperating end of collar 20, and nut 40 is rotatable about the cooperating end of collar 20. The first end 606 of nut 40 and bore 602 includes a tapered edge 603 to allow easier mating of nut 40 to collar 20. A third bore 604 is disposed within a second end 608 of nut 40, and extends a predetermined distance therein. Third bore 604 includes a plurality of threads 605 along its internal surface to allow the nut 40 to be threadably received and engaged by a cooperating connector (not shown). A seal may also be provided at the junction of nut 40 and collar 20.

FIG. 7 shows the connector 10 assembled onto a coaxial cable 70. Coaxial cable 70 comprises a center conductor 78 centrally disposed within the cable. The center conductor 78 is surrounded by a dielectric insulator (not shown). A conductive shield 74 surrounds the dielectric insulator and a jacket 76 surrounds the shield 74. In order to assemble the connector 10 onto a coaxial cable 70, the following steps are performed. An end of the coaxial cable 70 is prepared. The end of the coaxial cable 70 is stripped such that an end portion of the jacket 76 and shield 74 are removed, exposing an end section of the shield and dielectric insulator. The end portion of the dielectric insulator is removed to expose a section of the center conductor. The exposed end of the shield 74 is folded back along the outside of the jacket 76, as shown in FIG. 7. The prepared end of coaxial cable 70 is inserted through bore 412 of sleeve 24 and then into connector 10 such that the center conductor, dielectric insulator, conductive shield and jacket are positioned inside the bore 412 of sleeve 24. The center conductor extends completely through the connector. The dielectric insulator extends completely within the sleeve 24 and insulates the center conductor from the sleeve 24. The conductive shield 74 extends along the inner surface of sleeve 24 and is in electrical communication with the sleeve 24. Jacket 70 and conductive shield 74 are mechanically secured by the teeth 416 of the sleeve 24 when the sleeve 24 is press fit into the collar 20.

Figure 8A:
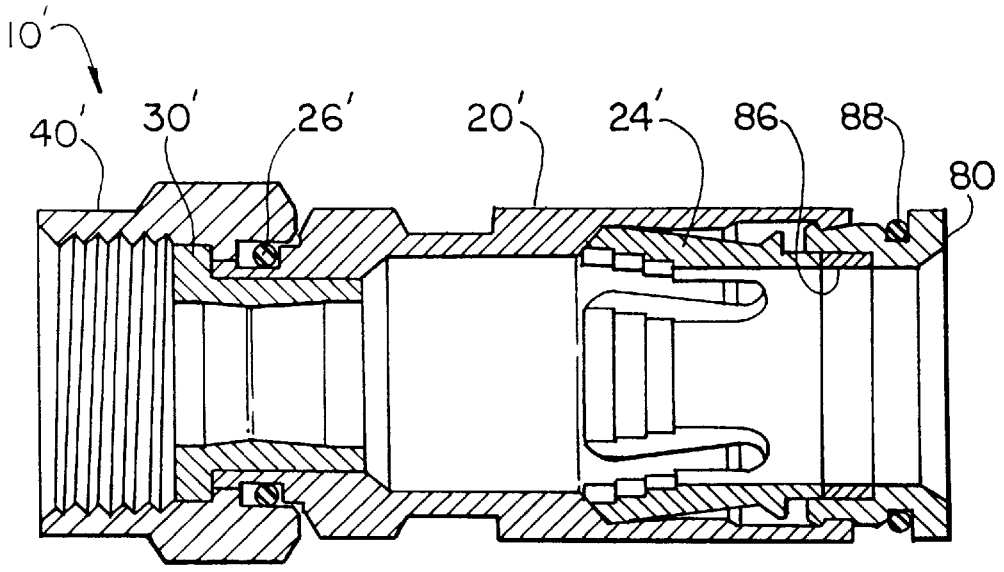
FIG. 8A is a cross-sectional view of another embodiment of a connector of the present invention.
Figure 8B:
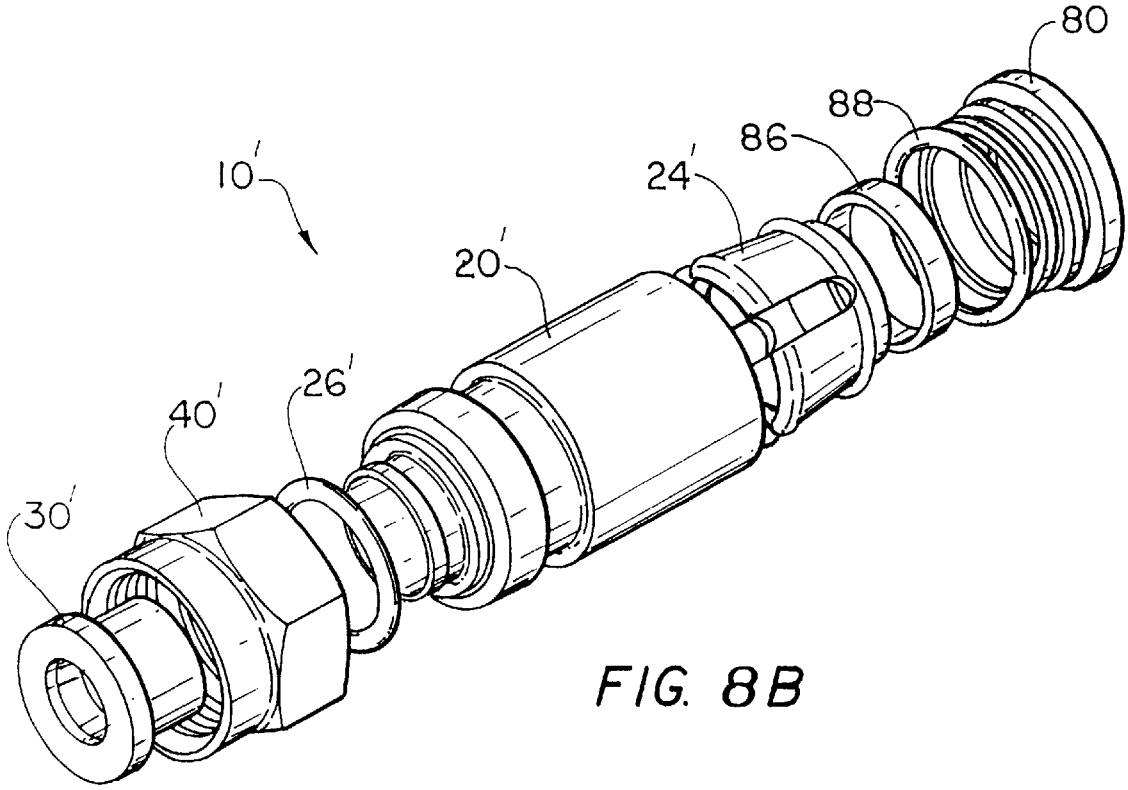
FIG. 8B is an exploded isometric view of the connector of FIG. 8A.

FIGS. 8A and 8B illustrate a second embodiment of a coaxial connector 10' according to the present invention. This embodiment is similar in configuration to the embodiment of FIGS. 1–7, with the noted differences of: the sleeve 24 being separated into a shorter sleeve 24' (shown in FIG. 11), an actuator 80 (shown in FIG. 12), and an additional sealing member 86; a modified collar 20' (shown in FIG. 9) configured to accommodate the actuator 80; and a modified ground coupler 30' (shown in FIG. 10).

Figure 9A:
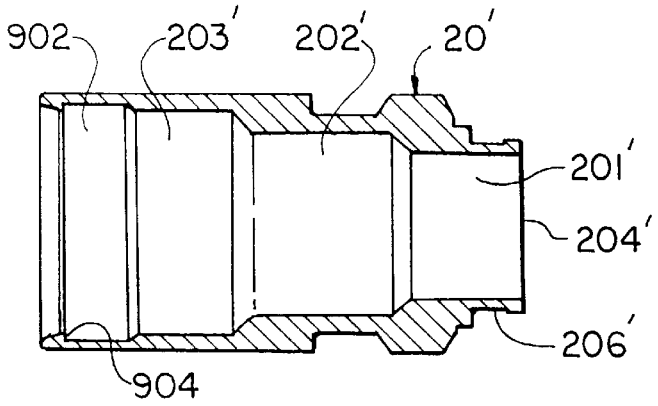
FIG. 9A is a cross-sectional view of the collar of FIGS. 8A and 8B.
Figure 9B:
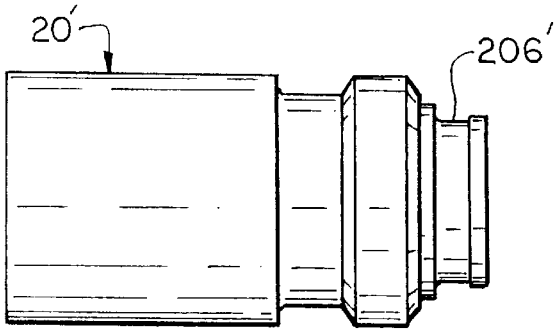
FIG. 9B is an illustration of the collar of FIGS. 8A and 8B.
Figure 9C:
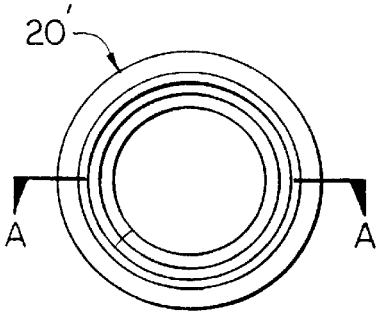
FIG. 9C is an end view of the collar of FIGS. 8A and 8B.

FIGS. 9A, 9B and 9C show the modified collar 20'. In this embodiment, the collar 20' includes an additional fourth bore 902, having a larger diameter than third bore 203', which is disposed a predetermined distance from a first end 204' and is configured to fit a first end 1202 of the actuator 80, shown in FIG. 12. The collar 20' includes an internal lip 904 for engaging and securing actuator 80 by locking an external lip 1204, shown in FIG. 12A, within fourth bore 902. Exterior annular grove 206' is provided and configured to receive a seal 26', as shown in FIG. 8A.

Figure 10A:
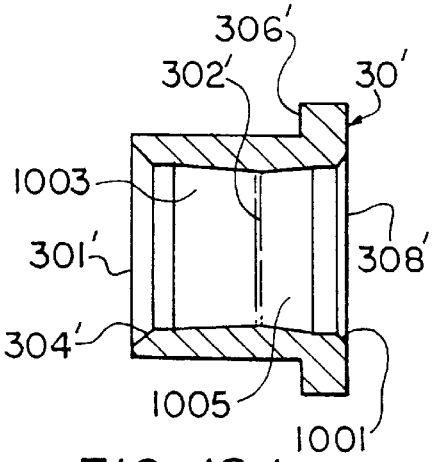
FIG. 10A is a cross-sectional view of the ground coupler of FIGS. 8A and 8B.
Figure 10B:
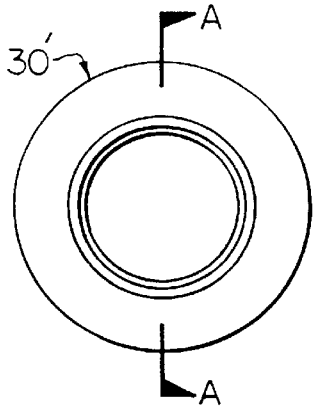
FIG. 10B is an end view of the ground coupler of FIGS. 8A and 8B.

Ground coupler 30', shown in FIG. 10, is substantially the same as ground coupler 30, shown in FIG. 3. Ground coupler 30' has a larger tapered edge 304' proximate the first end 301' and includes a second tapered edge 1001 proximate the second end 308' of the ground coupler 30'. The ground coupler 30' also includes an angular second bore 1003 and angular third bore 1005 disposed therein. External shoulder 306' is provided proximate the second end 308' of ground coupler 30' to abut an internal shoulder 609 of nut 40, which is the same as shown in FIG. 6, in order to secure the placement of the ground coupler 30' within the nut 40 and collar 20'.

Figure 11B:
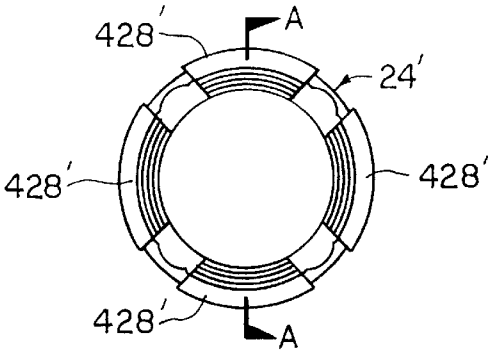
FIG. 11B is an end view of the sleeve of FIGS. 8A and 8B.
Figure 11A:
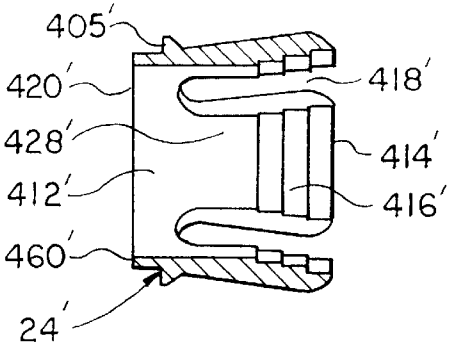
FIG. 11A is a cross-sectional view of the sleeve of FIGS. 8A and 8B.

FIGS. 11A and 11B show the shorter sleeve 24'. The sleeve 24' does not have a retaining ring nor a shoulder. The sleeve 24' includes a central bore 412' disposed therethrough, one or more slots 418' for creating sides 428', each of which have at least one tooth 416'. Lip 405' is provided to prevent sleeve 24' from becoming separated from collar 20' while cartridged inside collar 20'.

Figure 12B:
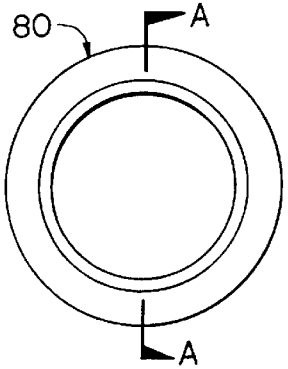
FIG. 12B is an end view of the actuator of FIGS. 8A and 8B.
Figure 12A:
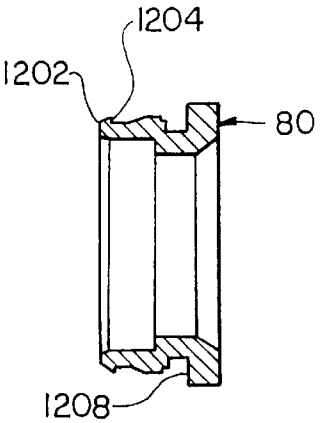
FIG. 12A is a cross-sectional view of the actuator of FIGS. 8A and 8B.

Now referring to FIGS. 12A and 12B, which show the actuator 80. The purpose of the actuator 80 is to push into the collar 20' to compress a sealing member 86, such as a gasket or rectangular ring, against the sleeve 24' forming a seal between the actuator 80 and a cable jacket of a coaxial cable. After the seal compresses, the actuator 80 butts up against the lip 405', shown in FIG. 11, on the sleeve 24', pushing it forward as its sides move inward to grip a coaxial cable with its teeth 416'. In an additional embodiment, the sealing member 86 separates the actuator 80 and the sleeve 24', and is pushed by the actuator 80 against a positive stop 460' of the sleeve 24' , pushing the sleeve 24' forward to allow its sides to secure a coaxial cable with its teeth 416'. These parts can be pre-installed or cartridged in the connector, as shown in FIG. 8A, which shows the connector as it could be sold. The actuator 80 can also be color coded, stamped or otherwise marked. The actuator can also include an actuator seal 88, such as an O-ring, which creates a seal between the collar 20' and the actuator 80.

In use, a coaxial cable has one end prepared for having the connector assembled onto. The prepared end of the coaxial cable is inserted into the second end of the sleeve (and actuator if included). The length of the sleeve (and actuator) provides cable strain relief as well as providing RF and environmental leakage protection. Further, the sleeve or the actuator may include tapered ends to allow for easier insertion and extension of the coaxial cable through the actuator and/or sleeve. The prepared end of the coaxial cable passes through the sleeve and into the second end of the collar. The prepared end of the coaxial cable is then fit within the first end of the sleeve, such that the outer jacket and conductive shield of the coaxial cable are positioned along the interior surface of the first end of the sleeve, and the center conductor and the dielectric insulator are disposed within the central bore of the sleeve and collar. The center conductor of the coaxial cable can extend entirely through the connector. The connector is assembled by press fit engagement of the collar with the sleeve. In this manner, the coaxial cable is secured within the connector by the teeth on the interior surface of sleeve 24. The connector can accommodate and be easily installed onto the stiffer polyethylene jacket of coaxial cables commonly used in Europe, as well as common polyvinyl chloride jackets.

In addition, the present invention can provide protection against contaminates and a reduction of the degradation of RF signals. Located along an outer surface of the collar 20 or 20' is a seal 26 or 26', and located along an outer surface of sleeve 24 or 24' is a sleeve seal 25 or 88. These seals can provide a reduction in the degradation of RF signal performance between the connector pieces when they are mated together. Additionally, the these seals serve to seal out contaminants. The seals are typically, and preferably, comprised of a material that provides ultra-violet light (UV) and ozone stability for maximum resistance to atmospheric ingress.

Environmental sealing of the connector can be accomplished in many different ways. For example, O-rings, rectangular cross-sectioned rings, gaskets, or seals of any other convenient shape can be used to create environmental seals. The seals can be fabricated from any suitable material such as ethylene, propylene, neoprene, or other elastomers or plastics. In addition, other types of sealants, such as silicon gel or a cured gel, such as a thixotropic gel, can also be used in various ways at various locations throughout the connector. For example, FIGS. 1, 4, and 7 show the use of seals in various locations, including an optional circumferential bump 79 on the inner diameter of the sleeve 24 as shown in FIG. 7. Moreover, FIG. 7 shows the use of an O-ring in various locations and a rectangular cross-sectioned ring or gasket between the actuator and the sleeve. Other types of seals and configurations of seals can be used in the connector 10 and 10'.

In any of the embodiments, all components of the connector can be fabricated from any number of materials. Including but not limited to plastics, such as DELRIN and/or metals such as brass. Preferably, to obtain desired grounding and RF performance the material chosen for the ground coupler should be sufficiently conductive.

The configuration of the embodiments disclosed form a connector which works with both common polyvinyl chloride (PVC) jacketed drop cable and polyethylene (PE) jacketed cable. PE cable is extremely rigid and has not been compatible with current connector designs that rely on the outward deformation of the jacket for cable retention and environmental seals. This invention in addition to working with both types of cables, exhibits a wider dynamic range than existing designs, and provides cable retention and an environmental seal for a greater span of cable dimensions.

One of the most noticeable differences between this design and existing connectors is the absence of a post that inserts underneath the braid and jacket of the cable. Removing the post greatly decreases the amount of manual insertion force required to put a cable into the connector. In previous connectors the post provided a means of cable retention, ground connection, and environmental seal. In the present invention, enhanced cable retention has been achieved through the use of the described slotted tooth laden sleeve. Moreover, environmental seals are improved with the described embodiments utilizing either the tooth laden sleeve or the sleeve and actuator combination. In addition, ground connection is improved through use of the ground coupler shown in FIGS. 3 and 9. The ground coupler has a tapered inner diameter that creates an interference between the inner circumference of the ground coupler and the outside of the foil (i.e., the outer conductor of the cable). The ground coupler provides a shorter ground path between the cable and the connector than compared to existing designs which relied on the braid for a ground connection. This configuration also provides improved RF performance.

The present invention is also extendable to include such applications as a flexible or drop cable, a splice connector, a feed through connector as well as including other cable sizes and types.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

What is claimed is:

1. A coaxial cable connector connectable to a plurality of coaxial cable sizes, said connector comprising:

a sleeve configured to receive and secure a coaxial cable;

a collar configured to receive said sleeve and press a portion of said sleeve into the coaxial cable;

a threaded nut having an end portion disposed coaxially around and rotatable about an end of said collar;

a coupler centrally disposed within an end of said collar and an end of said nut; and an actuator configured to receive a coaxial cable therethrough and apply a longitudinal force, which moves said sleeve in order to secure the coaxial cable.

2. A coaxial cable connector comprising:

a sleeve configured to receive a coaxial cable, said sleeve having at least one slot extending longitudinally forming a plurality of sides, each side having at least one tooth for securing a coaxial cable;

a collar configured to receive said sleeve substantially therein and press fit said plurality of sides of said sleeve into a coaxial cable;

a threaded nut having one end disposed coaxially around and rotatable about a mating area of said collar; and a coupler centrally disposed along a common longitudinal axis within one end of said collar and one end of said nut.

3. The connector of claim 2, wherein the coupler forms a conductive pathway for a braided shield of a coaxial cable.

4. The connector of claim 2, further comprising an actuator configured to receive a coaxial cable therethrough, said actuator centrally disposed along a common longitudinal axis substantially within said collar such that one end of said actuator abuts an end of said sleeve.

5. The connector of claim 2, further comprising:

a sealing member; and an actuator configured to receive a coaxial cable therethrough, said actuator centrally disposed along a common longitudinal axis substantially within said collar such that said actuator abuts said sealing member which abuts said sleeve.

6. The connector of claim 2, wherein said coupler and said nut are comprised of electrically conductive material.

7. The connector of claim 2, wherein said sleeve is comprised of metal.

8. The connector of claim 2, wherein said sleeve is comprised of plastic.

9. The connector of claim 2, wherein said sleeve includes a retaining ring integrally formed therewith.

10. The connector of claim 2, further comprising a sleeve seal disposed between an outer surface of said sleeve and inner surface of said collar.

11. The connector of claim 2, further comprising a connector seal disposed between an outer surface of said collar and inner surface of said nut.

12. A coaxial cable connector comprising:

a collar having a bore centrally disposed therethrough, a first mating area, and a second mating area;

a sleeve having a bore centrally disposed therethrough for receiving a coaxial cable, said sleeve having at least one slot extending longitudinally a predetermined length of said sleeve forming a plurality of sides having at least one tooth for securing a coaxial cable when said sleeve is press fit into the bore of said collar, said sleeve having a mating area for engaging with the first mating area of said collar;

a threaded nut having a bore centrally disposed therethrough and a mating area disposed coaxially around and rotatable about the second mating area of said collar; and a coupler having a bore centrally disposed therethrough, said coupler centrally disposed along a common longitudinal axis within one end of said collar and one end of said nut.

13. The connector of claim 12, wherein the central bore of said sleeve receives a conductor of a coaxial cable therethrough, said sleeve receives a dielectric, a conductive shield and a jacket of the coaxial cable therethrough, and wherein said sleeve is press fit within the bore of said collar such that the shield and the jacket of the coaxial cable are secured within said connector by at least one tooth of said sleeve, when said plurality of sides of said sleeve are pressed into the coaxial cable.

14. The connector of claim 12, further comprising an actuator having a bore centrally disposed therethrough for receiving a coaxial cable, said actuator centrally disposed along a common longitudinal axis substantially within said collar such that one end of said actuator abuts an end of said sleeve.

15. The connector of claim 12, further comprising:

a sealing member; and an actuator configured to receive a coaxial cable therethrough, said actuator centrally disposed along a common longitudinal axis substantially within said collar such that said actuator abuts said sealing member which abuts said sleeve.

16. The connector of claim 12, wherein said coupler and said nut are comprised of electrically conductive material.

17. The connector of claim 12, wherein said sleeve is comprised of metal.

18. The connector of claim 12, wherein said sleeve is comprised of plastic.

19. The connector of claim 12, wherein said sleeve includes a retaining ring.

20. The connector of claim 19, wherein said collar includes an annular surface configured to receive said retaining ring.

21. The connector of claim 12, further comprising a sleeve seal disposed between an outer surface of said sleeve and inner surface of said collar.

22. The connector of claim 12, further comprising a connector seal disposed between an outer surface of said collar and inner surface of said nut.

23. A coaxial cable connector comprising:

a collar opened on each of two ends having a bore centrally disposed therethrough, a first end having a first mating area and a second end having a second mating area;

a sleeve opened on each of two ends, having a first end, a second end and a bore centrally disposed therethrough, the first end configured to receive a coaxial cable and having at least one slot extending longitudinally toward the second end of said sleeve forming a plurality of sides, each side having at least one tooth, the second end of said sleeve having a mating area that is engageable with the first mating area of the first end of said collar;

a threaded nut opened on each of two ends, having a first end, a second end and a bore centrally disposed therethrough, the first end of said nut disposed coaxially around and rotatable about the second mating area of said collar; and a ground coupler opened on each of two ends, having a first end, a second end and a bore centrally disposed therethrough, said ground coupler centrally disposed along a common longitudinal axis within the second end of said collar and the first end of said nut.

24. The connector of claim 23, further comprising an actuator opened on each of two ends, having a first end configured to receive a coaxial cable and having a bore centrally disposed therethrough, said actuator having a shoulder for abutting the outer edge of the first side of said collar, said actuator centrally disposed along a common longitudinal axis within the first end of said collar, and disposed substantially within said collar such that the second end thereof abuts the second end of said sleeve.

25. The connector of claim 23, further comprising:

a sealing member having two ends; and an actuator opened on each of two ends, having a first end configured to receive a coaxial cable and having a bore centrally disposed therethrough, said actuator having a shoulder for abutting the outer edge of the first side of said collar, said actuator centrally disposed along a common longitudinal axis within the first end of said collar, and disposed substantially within said collar such that the second end thereof abuts one end of said sealing member and the other end of said sealing member abuts the second end of said sleeve.

26. The connector of claim 23, further comprising a sleeve seal recess annularly disposed along an outer surface of said sleeve.

27. The connector of claim 26, further comprising a sleeve seal disposed within the sleeve seal recess.

28. The connector of claim 25, further comprising a seal receiving surface annularly disposed about an outer surface of said collar.

29. The connector of claim 28, further comprising a seal disposed about the seal receiving surface.

30. The connector of claim 23, wherein said ground coupler and said nut are comprised of electrically conductive material.

31. The connector of claim 23, wherein said sleeve is comprised of plastic.

32. The connector of claim 23, wherein said sleeve is comprised of metal.

33. The connector of claim 23, wherein said ground coupler includes a tapered end.

34. The connector of claim 23, wherein said sleeve includes a tapered end.

35. The connector of claim 23, wherein said actuator includes a tapered end.

36. The connector of claim 23, wherein said sleeve includes a retaining ring.

37. The connector of claim 36, wherein said collar includes an annular surface for receiving said retaining ring.

38. The connector of claim 23, wherein the central bore of said sleeve receives a conductor of a coaxial cable therethrough, said sleeve receives a dielectric, a conductive shield and a jacket of the coaxial cable therethrough, and wherein said sleeve is press fit within said collar such that the shield and the jacket of the coaxial cable are secured within said connector by the teeth of said sleeve.

* * * * *

UNITED STATES PATENT AND TRADEMARK OFFICE

CERTIFICATE OF CORRECTION

PATENT NO. : 6,089,912
DATED : July 18, 2000
INVENTOR(S) : John R. Tallis et al.

It is certified that error appears in the above-identified patent and that said Letters Patent is hereby corrected as shown below:

Column 1,
Line 28, "on of" should read -- transmission of --;
Line 30, "fitted at" should read -- fitted to at --.

Signed and Sealed this

Twenty-eighth Day of May, 2002

*Attest:*

*Attesting Officer*

JAMES E. ROGAN
*Director of the United States Patent and Trademark Office*